US008029202B2

(12) United States Patent
Takahashi et al.

(10) Patent No.: US 8,029,202 B2
(45) Date of Patent: Oct. 4, 2011

(54) PRINTER WITH RECORDING PAPER LEADING EDGE STORAGE UNIT

(75) Inventors: Akira Takahashi, Nagano (JP); Yuichi Taguchi, Nagano (JP); Yutaka Inokuchi, Nagano (JP)

(73) Assignee: Citizen Holdings Co., Ltd., Nishitokyo-shi, Tokyo (JP)

( * ) Notice: Subject to any disclaimer, the term of this patent is extended or adjusted under 35 U.S.C. 154(b) by 794 days.

(21) Appl. No.: 12/048,642

(22) Filed: Mar. 14, 2008

(65) Prior Publication Data

US 2009/0232574 A1 Sep. 17, 2009

(51) Int. Cl.

| | |
|---|---|
| ***B41J 2/32*** | (2006.01) |
| ***B41J 15/04*** | (2006.01) |
| ***B65H 29/60*** | (2006.01) |
| *B41J 2/325* | (2006.01) |

(52) U.S. Cl. ... 400/613; 400/614; 400/693; 400/120.02; 347/174

(58) Field of Classification Search ..... 400/613, 400/120.02, 120.04, 614, 614.1, 240.4; 347/176, 347/174

See application file for complete search history.

(56) References Cited

U.S. PATENT DOCUMENTS

| | | | | |
|---|---|---|---|---|
| 6,297,840 | B1 * | 10/2001 | Inana | 347/175 |
| 7,733,361 | B2 * | 6/2010 | Choi et al. | 347/171 |
| 2008/0317496 | A1 * | 12/2008 | Kim et al. | 399/108 |

FOREIGN PATENT DOCUMENTS

| | | | |
|---|---|---|---|
| JP | 04151175 A | * | 5/1992 |
| JP | 8-67041 A | | 3/1996 |
| JP | 09-254419 A | | 9/1997 |
| JP | 10-217565 A | | 8/1998 |
| JP | 11091145 A | * | 4/1999 |
| JP | 2001010091 A | * | 1/2001 |
| JP | 2003260834 A | * | 9/2003 |
| JP | 2004181835 A | * | 7/2004 |
| JP | 2005-059359 A | | 3/2005 |
| JP | 2005-060016 A | | 3/2005 |
| JP | 2005231198 A | * | 9/2005 |

OTHER PUBLICATIONS

Japanese Office Action dated Mar. 10, 2011, issued in related Japanese Patent Application No. 2006-324614.

* cited by examiner

*Primary Examiner* — Daniel J Colilla
(74) *Attorney, Agent, or Firm* — Westerman, Hattori, Daniels & Adrian, LLP

(57) ABSTRACT

A printer, which prints by repeatedly reciprocating a rolled recording paper and ejects a printed recording paper, has therein a recording paper storage unit in which the recording paper is temporarily stored. The recording paper storage unit has a configuration formed by at least a part of the periphery of the rolled recording paper or a configuration provided in a space between the rolled paper holder and an ejection slot. This configuration eliminates the need for separately providing a configuration in which a recording paper is set aside when printing a long sheet of printed material and, at the same time, makes the printer smaller.

14 Claims, 17 Drawing Sheets

PRINTER WITH RECORDING PAPER LEADING EDGE STORAGE UNIT

FIELD OF THE INVENTION

The present invention relates to a printer that prints different colors on the same paper by reciprocating a rolled recording paper under the head to repeat printing on a recording paper multiple times.

RELATED ART

A multi-color printer for use in color printing uses three primary colors (yellow, magenta, and cyan) or four colors including black. One of such multi-color printers that are known is a printer that prints different colors on the same paper by repeating printing multiple times with a rolled recording paper reciprocating (For example, see Patent Document 1).

To print on a recording paper, fed from the feed roller, with the use of the head, the printer disclosed in Patent Document 1 stores the recording paper, on which one color is printed with the use of one color head, in the recording paper storage unit. To print the next color, the printer rolls back the recording paper stored in this recording paper storage unit, passes the recording paper again under the next color head to print on the printed paper, and stores the printed recording paper in the recording paper storage unit. In this way, the printer stores the recording paper into, and takes it out from, the recording paper storage unit each time the printer prints a color.

This printer has switching guide means that switches the recording paper between the recording paper storage unit and the recording paper cutting unit. The printer switches this switching guide means for guiding the recording paper into the recording paper storage unit when printing is performed, and into the recording paper cutting unit after printing is finished.

[Patent Document 1] Japanese Patent Laid-Open Publication No. Hei 8-67041

The printer described above that repeats printing multiple times with a rolled recording paper reciprocating requires that the recording paper be set aside. Setting aside the recording paper, in turn, requires a recording paper storage unit in which the recording paper is temporarily stored. This recording paper storage unit, which must be provided between the head and the recording paper cutting unit, requires its installation space in the housing of the printer.

This recording paper storage unit must be provided in the downstream side of the head and, to allow f or the smooth switching of the recording paper ejection direction between the ejection exit side and the recording paper storage unit side with no damage on the recording paper, a sufficient distance must be provided between the head and the recording paper storage unit. This sufficient distance between the head and the recording paper storage unit, if provided, makes the printer larger.

To store the recording paper the situation of which is rolled, the recording paper storage unit must have a cylindrical shape that forms a storage space therein. This requirement creates a problem that the recording paper storage unit becomes vertically or horizontally large according to the diameter of this cylindrical body and, as a result, the printer becomes large.

To store the recording paper the situation of which is unrolled, the recording paper storage unit must have a box shape that forms a storage space therein. This requirement creates a problem that the recording paper storage unit becomes large horizontally according to the length or width of this box-shaped body and, as a result, the printer becomes large.

For this reason, in whichever way the recording paper is stored, reserving the space for installing the recording paper storage unit within the printer housing requires a larger printer housing and so the problem is that the printer becomes large.

A still another problem is that, because the length of an image on a recording paper is limited by the length of a recording paper stored in the recording paper storage unit, the image cannot printed in a print area longer than the recording paper stored in the recording paper storage unit.

In view of the foregoing, it is an object of the present invention to solve the problems described above. More specifically, in a printer that performs printing repeatedly with a rolled recording paper reciprocating, an object of the present invention is to reserve a recording paper set-aside space without separately preparing it and thereby to reserve a recording paper set-aside space without making the printer large.

It is another object of the present invention to allow for printing in a print area that is longer than a recording paper stored in the recording paper storage unit.

SUMMARY OF THE INVENTION

The present invention provides two embodiments in which a storage space is provided in a printer for temporarily storing a recording paper.

In a first embodiment of the present invention, at least a part of the outer peripheral space of a rolled paper holder, which holds a rolled recording paper, is used to form a storage space where the recording paper is temporarily stored.

In the first embodiment, a printer comprises a rolled paper holder that holds a rolled recording paper; an ejection path through which the recording paper is ejected externally of the printer; a recording paper storage unit in which the recording paper is temporarily stored; and a switching guide unit that guides a leading edge of the recording paper by switching between the ejection path and the recording paper storage unit wherein the recording paper storage unit is formed at least by a part of a periphery of the rolled recording paper.

Normally, the outer peripheral part of the rolled paper holder has a space for storing the rolled paper or a space for unrolling the rolled paper and feeding the unrolled paper. Because the diameter of the periphery of the rolled paper holder is set normally to an outer diameter that has a margin so that the outer peripheral part of the rolled paper does not contact the inside wall of the printer even when an unused rolled paper is stored and the diameter of the rolled paper is the maximum, an extra space is provided in the outer peripheral part of the rolled paper holder.

After the rolled paper on the rolled paper holder is unrolled, at least the space where the rolled paper was rolled becomes idle space. So, the outer peripheral part of the rolled paper has a space sufficient for storing at least a recording paper that is unrolled from the rolled paper and fed for printing.

The printer in the first embodiment of the present invention uses the space of the outer peripheral part of the rolled paper holder as a space for refuge where the recording paper is set aside, thus reserving a recording paper set-aside space without separately providing it within the printer.

In a second embodiment of the present invention, a storage space for temporarily storing a recording paper is formed in a gap in the printer and, as a result, a set-aside space for a recording paper is provided in the printer without separately providing a space for refuge.

In one mode of the second embodiment, a printer comprises a rolled paper holder that holds a rolled recording paper; a head that prints on the recording paper unrolled from a roll into a long sheet of paper; a recording paper storage unit in which the recording paper that has passed under the head is stored temporarily; and an ejection slot through which the printed recording paper is ejected wherein the head and the ejection slot are provided on both sides across the rolled paper holder in a conveyance direction of the recording paper and the recording paper storage unit is provided between an ejection slot side part of the rolled paper holder and the ejection slot.

In another mode of the second embodiment, a printer comprises a rolled paper holder that holds a rolled recording paper; an ejection path through which the recording paper is ejected externally of the printer; a recording paper storage unit in which the recording paper is temporarily stored; and a switching guide unit that guides a leading edge of the recording paper by switching between the ejection path and the recording paper storage unit wherein the recording paper storage unit is provided in a space between the rolled paper holder and a front wall on a side on which the recording paper is ejected.

In the prior art configuration where the head and the ejection slot are provided on one side of the rolled paper holder, a space is required in the printer only to reserve a distance between the head and the recording paper storage unit.

In contrast, in the first embodiment of the present invention, the recording paper storage unit is formed using at least a part of the periphery of the rolled recording paper and, thereby, a recording paper set-aside space can be reserved. In the second embodiment of the present invention, the head and the ejection slot are provided on both sides across the rolled paper holder to allow a part of the space required for a distance between the head and the recording paper storage unit to be used for storing the rolled paper holder. This configuration improves the space efficiency in the printer and makes the printer compact.

In the configuration in which the recording paper is stored in the recording paper storage unit, the switching guide unit performs the switching operation to guide the leading edge of the recording paper to the recording paper storage unit. This switching guide unit, provided in the downstream side of the head, performs the switching operation to temporarily guide the recording paper either to the recording paper storage unit side for temporarily setting aside the recording paper or to the ejection path side for ejecting the recording paper externally of the printer.

When an image equal to or shorter than the storage length of the recording paper storage unit is printed, the switching guide unit of the present invention guides the leading edge of the recording paper that is being printed to the recording paper storage unit, and guides the leading edge of the recording paper that has been printed to the ejection path. This switching guide unit switches the destination direction of the leading edge of the recording paper to allow the recording paper, which is being printed, to be set aside temporarily in the recording paper storage unit for repeated printing and, after the printing is finished, ejects the recording paper externally of the printer via the ejection path.

Because the recording paper storage unit provides a space in which a rolled paper is held, this configuration allows the printer housing to shield the recording paper, which is being printed and temporarily set aside, from the external environment and, thereby, prevents dirt and dust from accumulating on the surface of the recording paper being printed, thus ensuring the print quality.

On the other hand, because the recording paper storage unit is too short to store the recording paper when an image longer than the storage length of the recording paper storage unit is printed, the image cannot be printed with the recording paper set aside in the recording paper storage unit. So, when printing is being performed and printing is finished, the switching guide unit switches the recording paper destination so that the leading edge of the recording paper is guided to the ejection path side. By doing so, when printing is being performed, the recording paper is temporarily set aside with the recording paper once stuck out from the ejection slot. When printing is finished, the recording paper is ejected from the ejection slot externally of the printer via the ejection path. As described above, when the recording paper being printed is temporarily set aside externally of the printer housing, there is a possibility that dirt and dust accumulate on the surface of the recording paper being printed.

The switching guide unit of the present invention can be configured by a flapper plate. This flapper plate is pivotally supported in at least two switching positions including a first switching position, via which the leading edge of the recording paper is guided to the recording paper storage unit side, and a second switching position, via which the leading edge of the recording paper is guided to the ejection path side. Changing this switching position switches the destination of the leading edge of the recording paper and guides the recording paper to the recording paper storage unit side or to the ejection path side.

The switching guide unit sets the flapper plate to the first switching position at least when printing is started and switches the flapper plate from the first switching position to the second switching position when printing is terminated. The time at which the switching position of the flapper plate is switched is when printing is started or terminated, and this time can be synchronized with the print control of the printer.

On the other hand, when an image longer than the storage length of the recording paper storage unit is printed, the switching guide unit sets the flapper plate to the second switching position to guide the leading edge of the recording paper to the ejection path side during printing. In this case, the flapper plate remains in the first switching position both in the state in which printing is performed and in the state the recording paper is ejected after printing.

The rolled recording paper of the present invention has a central axis that is supported to allow the rolled recording paper to be rotatably stored on the rolled paper holder.

The printer of the present invention further comprises, on the ejection path, a recording paper cutting unit that cuts the recording paper; and an ejection slot through which the recording paper is ejected externally of the housing of the printer. Below this recording paper cutting unit, the printer further comprises a chip storage unit in which chips of the recording paper cut by the recording paper cutting unit are stored. This configuration stores the chips of the recording paper, cut by the recording paper cutting unit, in the chip storage unit within the printer to prevent the chips from being leaked from the printer.

In the second embodiment of the present invention, one of the wall surfaces of the recording paper storage unit of the printer can be formed by a dividing plate provided adjacent to at least a part of the periphery of the rolled paper holder. In the configuration in which the head and the ink ribbon are provided at the back of the side opposite to the front wall across the rolled paper holder, the dividing plate is provided in a position that is adjacent to the periphery of the rolled paper holder and that is on the side opposed to the front wall. Providing this dividing plate prevents the recording paper, unrolled from the rolled paper holder, from coming into contact with recording paper rolled on the rolled paper holder and thereby from the printed paper surface of the recording paper from being damaged or smeared.

In the second embodiment of the present invention, another wall surface configuring the recording paper storage unit of the printer may be formed not only by the wall surface of the chip storage unit, in which the recording paper that is cut is stored, or the front wall of the printer but also by a second dividing plate provided adjacent to the front wall.

The printer of the present invention, which reciprocates a rolled recording paper repeatedly for printing thereon, can reserve the recording paper set-aside space without separately reserving said space and, thereby, reserve the recording paper storage unit set-aside space without making the printer larger.

Even if the printing of an image longer than the recording paper that will be stored in the recording paper storage unit is requested, the switching guide unit does not guide the recording paper to the recording paper storage unit, but temporarily sticks the recording paper out of the printer, to print the image.

DETAILED DESCRIPTION OF PREFERRED EMBODIMENTS

Embodiment of a printer according to the present invention will be described below with reference to FIG. 1 to FIG. 17.

Figure 1:
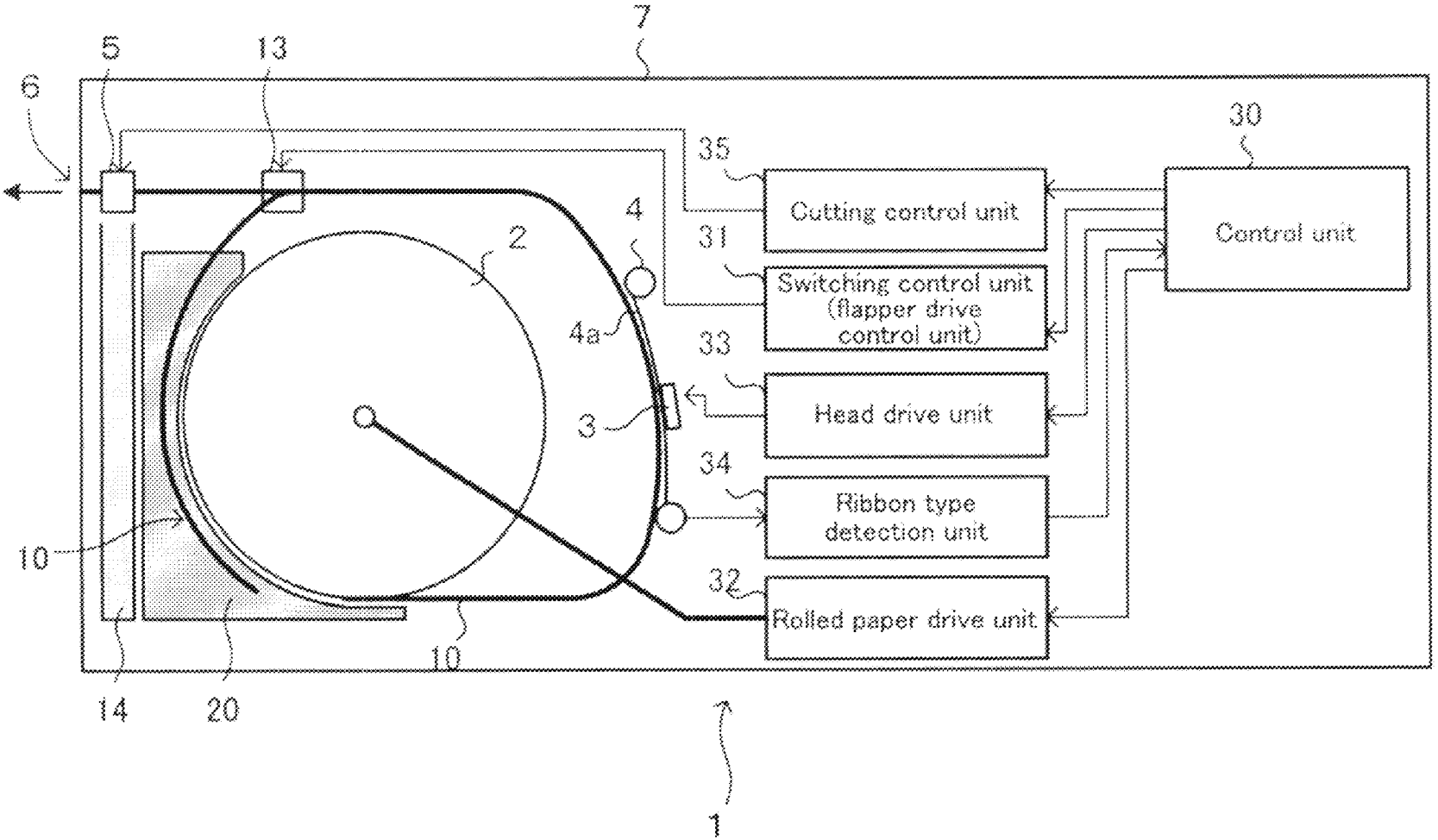
FIG. 1 is a diagram showing the general configuration of a first embodiment of a printer of the present invention.
Figure 2:
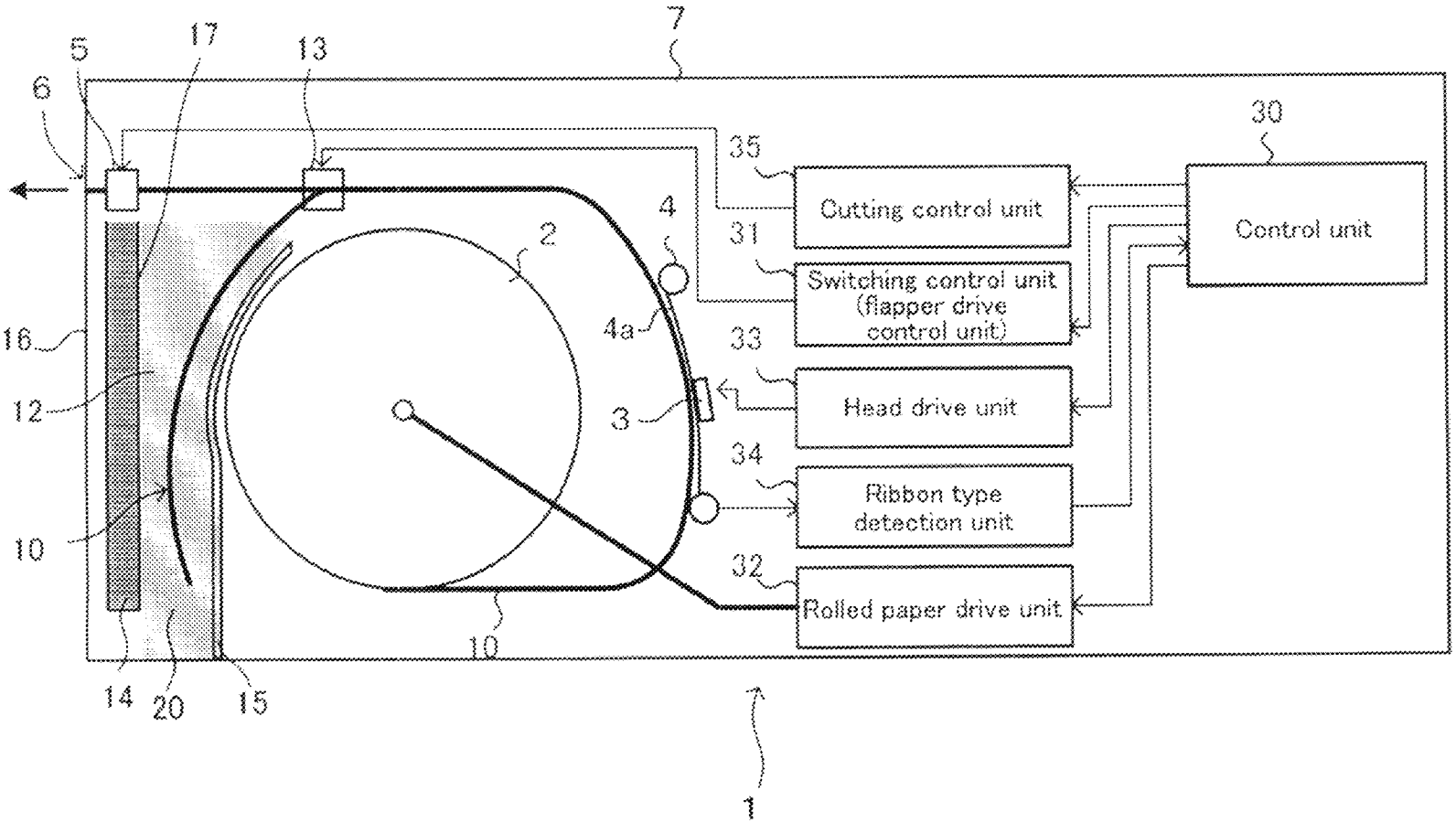
FIG. 2 is a diagram showing the general configuration of a second embodiment of a printer of the present invention.

FIG. 1 is a diagram showing the general configuration of a first embodiment of a printer according to the present invention, and FIG. 2 is a diagram showing the general configuration of a second embodiment of a printer according to the present invention.

Note that, in FIGS. 1 and 2, only the components of a printer 1 required for the description of the present invention are shown and other components are omitted.

The printer 1 holds a rolled recording paper 10 on a rolled paper holder 2 and prints on the recording surface of the recording paper 10 unrolled back from the rolled paper holder 2. To hold the rolled recording paper 10 on the rolled paper holder 2, the central axis of the rolled recording paper 10 is supported rotatably by the rolled paper holder 2. This structure allows the recording paper 10 to be stored rotatably on the rolled paper holder 2.

Printing is performed, for example, by recording ink in predetermined positions using a head 3 with an ink ribbon 4*a*, held by an ink ribbon cassette 4, abutting on the recording surface of the recording paper 10. To perform multi-color printing such as color printing during this printing, multiple ink parts, such as yellow, magenta, and cyan corresponding to the colors to be printed, are prepared on the ink ribbon 4*a* sequentially along the winding direction of the ink ribbon 4*a*, and the operation in which the ink part passes under the head 3 is repeated for each color while winding the ink ribbon 4*a*. At this time, the recording paper 10 is reciprocated to overlay the colors in the same print area on the recording paper 10. The recording paper 10 can be reciprocated by changing the rotational direction of the rolled paper holder 2 to repeatedly unroll and roll the rolled paper.

This operation causes the recording paper 10 to be reciprocated under the head 3 and repeats printing in the same print area on the recording paper 10 multiple times.

The ink ribbon has the color parts (yellow, magenta, and cyan) as well as the overcoat layer that covers the print surface, on which all colors are printed, for protecting it.

The recording paper 10, which has been printed, passes under the head 3, passes through an ejection path 13, and is ejected externally of the printer through an ejection slot 6 provided on a housing 7 of the printer 1. In the configuration shown in FIG. 1, the ejection slot 6 is provided on a front wall 16 of the housing 7 of the printer 1.

For printing each color, the recording paper 10 once passes under the head 3 and is fed for the length corresponding to the print length and, after that, is reversed and rolled. The head 3 prints an image when the recording paper 10 is rolled. This means that the recording paper 10 that has passed under the head 3 must be set aside temporarily within the printer 1.

In the first embodiment of the present invention shown in FIG. 1, the printer 1 uses the peripheral part of the rolled paper holder 2 as a recording paper storage unit 12 and uses that part as a storage space where the recording paper is temporarily set aside. In FIG. 1, the recording paper storage unit 12 is indicated by the shaded part. This recording paper storage unit 12 is created using a space in the peripheral part of the rolled paper holder 2, with the storage space formed by a gap between at least a part of the whole periphery and the inside wall of the printer. Normally, the peripheral part of the rolled paper holder has a space for storing the rolled paper and for unrolling and feeding the unrolled paper. Because the diameter of the periphery of the rolled paper holder is normally large enough to have a margin so that the peripheral part of the rolled paper does not contact the inside wall of the printer even when the diameter of this rolled paper is the maximum, an extra space is provided in the peripheral part of the rolled paper holder. After the rolled paper on the rolled paper holder is unrolled, at least the space where the rolled paper was rolled becomes, idle space.

So, the peripheral part of the rolled paper has a space sufficient for storing at least a recording paper that is unrolled from the rolled paper and fed for printing.

The printer 1 of the present invention uses the space of the peripheral part of the rolled paper holder 2 as a storage space 20 where the recording paper is set aside, thus reserving a recording paper set-aside space without separately providing it within the printer.

In the second embodiment of the present invention shown in FIG. 2, a printer 1 has a recording paper storage unit 12 in the space between a rolled paper holder 2 and a front wall 16 through which a recording paper is ejected, and a recording paper 10 unrolled from the rolled paper holder 2 is temporarily set aside in this recording paper storage unit 12. In FIG. 2, a storage space 20 of the recording paper storage unit 12 is indicated by the shaded part.

This recording paper storage unit 12 uses the space between the rolled paper holder 2 and the front wall 16, through which the recording paper is ejected, to form a storage space.

The storage space of the recording paper storage unit 12 may have a configuration in which its border is determined by partition plates or a configuration in which the border is determined, not by partition plates, but by a member present in the space between the rolled paper holder 2 and the front wall 16.

In the configuration where the border of the storage space 20 is set by the partition plates, a partition plate 15 is provided at a position adjacent to the rolled paper holder 2 as a partition plate on the rolled paper holder 2 side. On the other hand, a second partition plate 17 is provided at a position adjacent to the front wall 16 as a partition plate on the front wall 16 side. The recording paper storage unit 12 forms the storage space 20 by the part bounded by the partition plate 15 and the second partition plate 17.

In the configuration where the border of the storage space 20 is set, not by the partition plates, but by members in the printer, the rolled paper holder 2 is used as one of the borders of the storage space 20 on the rolled paper holder 2 side, and either the inside wall of the front wall 16 or the inside wall of a chip storage unit 14, in which chips generated when the recording paper 10 is cut is stored, is used as the other border of the storage space 20 on the front wall 16 side. In this configuration, the recording paper storage unit 12 forms the storage space 20 by the part between the rolled paper holder 2 and the inside wall of the front wall 16 or by the part between the rolled paper holder 2 and the inside wall of the chip storage unit 14.

The border on the rolled paper holder 2 side and the border on the front wall 16 side may be combined in various ways in the configuration in which the partition plates are used as borders or in the configuration in which members in the printer are used as borders. For example, both borders are set by partition plates, both borders are set by members of the printer, or one boarder is set by a partition plate and the other by a member in the printer.

The printer 1 in the second embodiment of the present invention uses the space between the rolled paper holder 2 and the front wall 16 as the storage space 20 in which the recording paper is set aside, thus reserving the recording paper set-aside space without separately providing it in the printer.

In the first embodiment and the second embodiment of the present invention, a switching guide unit 11 is provided in the downstream of the head 3 and in the upstream of the recording paper storage unit 12 and the ejection path 13. This switching guide unit 11 switches the leading edge of the recording paper 10, which has passed under the head 3, to the recording paper storage unit 12 or to the ejection path 13 for guiding the recording paper 10 to the desired switching direction. This switching guide unit 11 may be configured, for example, by a flapper plate that will be described later.

The printer 1 also has a recording paper cutting unit 5 on the ejection path 13 and immediately before the ejection slot 6. The recording paper cutting unit 5 cuts the recording paper 10, which has passed through the ejection path 13 and which is sent out externally from the ejection slot 6, at the position before the ejection slot 6. With the recording paper 10 stuck out from the ejection slot 6, the recording paper cutting unit 5 cuts the recording paper 10 at a predetermined position of its trailing part to allow the recording paper 10, which has been cut, to be taken out from the ejection slot 6. In addition, before the recording paper 10 is stuck out from the ejection slot 6, the recording paper cutting unit 5 can cut the recording paper 10 at multiple positions to cut it into small chips.

Below the recording paper cutting unit 5 is provided the chip storage unit 14 that stores the chips generated by the recording paper cutting unit 5. Storing the chips in the chip storage unit 14 prevents the chips from being leaked from the printer 1.

In the configuration of the first embodiment shown in FIG. 1, the chip storage unit 14, provided at a position adjacent to the rolled paper holder 2, establishes the other border of the recording paper storage unit 12 formed by the periphery of the rolled paper holder 2 described above. Although an example is shown in FIG. 1 in which a part of the border of the recording paper storage unit 12 is formed by the wall surface of the chip storage unit 14, the surface that, together with the periphery of the rolled paper holder 2, forms the border of the recording paper storage unit 12 is not limited to the wall surface of this chip storage unit 14. The surface of any component arranged in the position opposed to the periphery of the rolled paper holder 2 in the printer 1 may also be used.

In the first embodiment and the second embodiment the printer 1 comprises drive units (rolled paper drive unit 32, head drive unit 33) that drive the components described above or control units (control unit 30, switching control unit 31, cutting control unit 35) that perform the control operation. In addition to the units described above, the printer 1 further comprises a detection unit (ribbon type detection unit 34) that detects the detection signal for acquiring the control condition.

The rolled paper drive unit 32 drives the rolled paper stored in the rolled paper holder 2. The rolled paper drive unit 32, which can reverse the drive direction, feeds the recording paper 10 by rotating the rolled paper in the direction in which the rolled paper is unrolled and pulled out, and restores the fed recording paper 10 by reversing the drive direction to rotate the rolled paper in the direction in which the rolled paper is rolled. The printer of the present invention prints on the recording paper 10 when the fed recording paper 10 is restored.

The head drive unit 33 drives the head based on image data and prints predetermined images or characters on the recording paper 10. The head may use any mechanism according to various print methods of the printers such as a sublimatic printer or a thermal-transfer printer. The printer 1 further comprises an ink ribbon drive unit (not shown in FIG. 1) that drives the ink ribbon 4 and, in synchronization with the head drive operation, causes the ink ribbon 4 to move with the head for printing on the recording paper 10.

When printing with the ink ribbon, the length of a print on the recording paper 10 depends on the length of the color part of the ink ribbon. For example, when an image corresponding to the L-size or 2L-size picture is printed, the ink ribbon has the size corresponding to the L-size or 2L-size and the image is printed by moving the ink ribbon for the horizontal length.

So, the driving amount of the rolled paper drive unit 32 and the ink ribbon drive unit (not shown) must be determined according to the type of the ink ribbon 4*a* mounted on the printer 1. For this reason, a storage element (not shown) such as an RFID chip, in which type data on this ink ribbon 4*a* is recorded, is mounted on the ink ribbon cassette 4 so that the ribbon type detection unit 34 can detect this storage element. The control unit 30 acquires the type of ink ribbon from the detected data and, based on the acquired ink ribbon type, controls the driving amount of the rolled paper drive unit 32 and the ink ribbon drive unit (not shown).

The switching control unit 31 controls the switching guide unit 11 to switch the direction, into which the leading edge of the recording paper 10 should be sent, to one of two sides: recording paper storage unit 12 side or ejection path 13 side. This switching is controlled as follows. When the print operation is being performed, the leading edge of the recording paper 10 is switched to the recording paper storage unit 12 side in order to temporarily set aside the recording paper 10 therein; when the print operation is terminated, the leading edge of the recording paper 10 is switched to the ejection path 13 side in order to eject the recording paper 10 from the ejection slot 6.

The recording paper cutting control unit 35 controls the recording paper cutting unit 5 to cause it to cut the recording paper 10 at its trailing edge of the recorded part into a sheet of recording paper when the recording paper 10, conveyed along the ejection path 13, is ejected externally of the ejection slot 6 or to cut the recording paper 10 into small pieces for discarding purposes.

Figure 3:
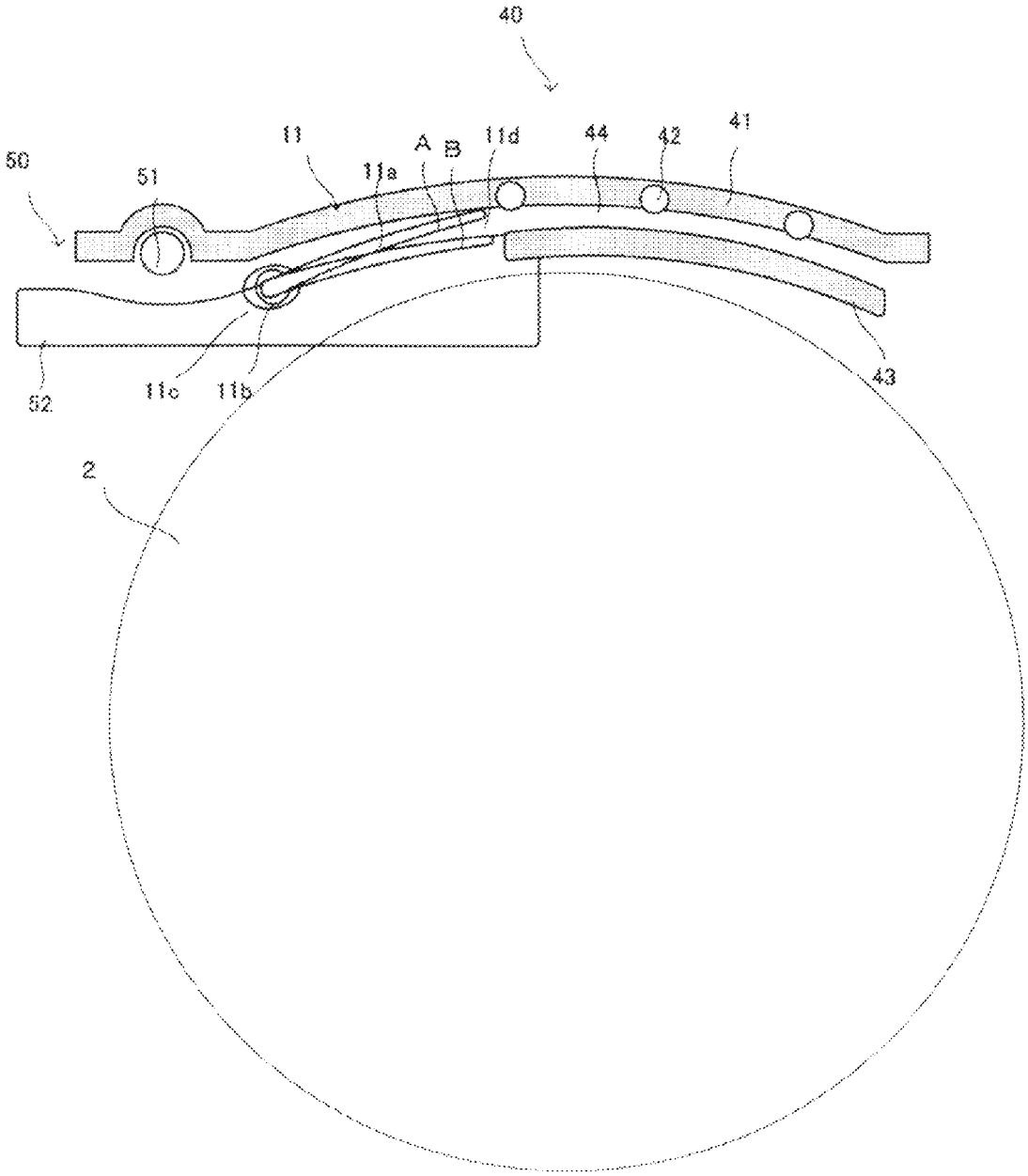
FIG. 3 is a cross section diagram showing an example of the configuration of a switching guide unit by means of a flapper plate of the present invention.
Figure 4:
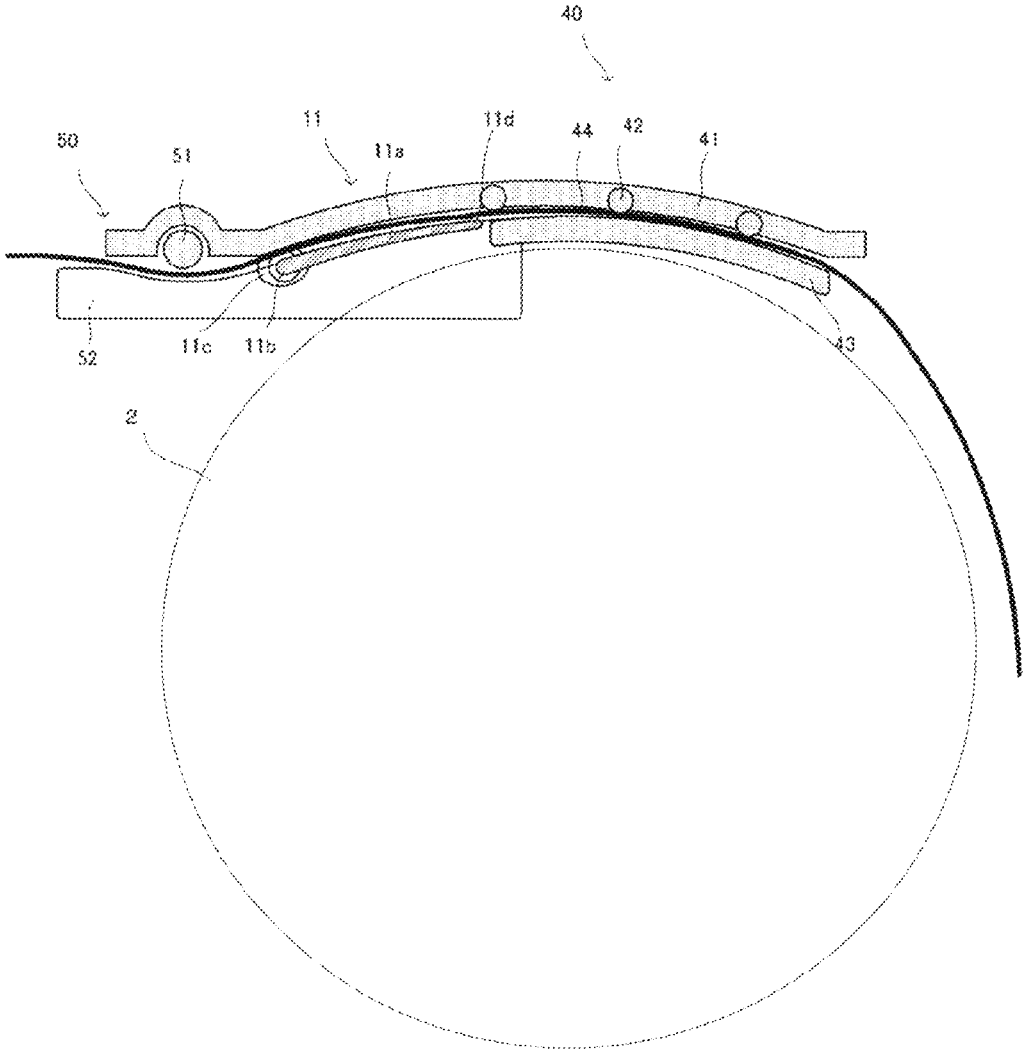
FIG. 4 is a cross section diagram showing an example of the configuration of the switching guide unit by means of the flapper plate of the present invention.
Figure 5:
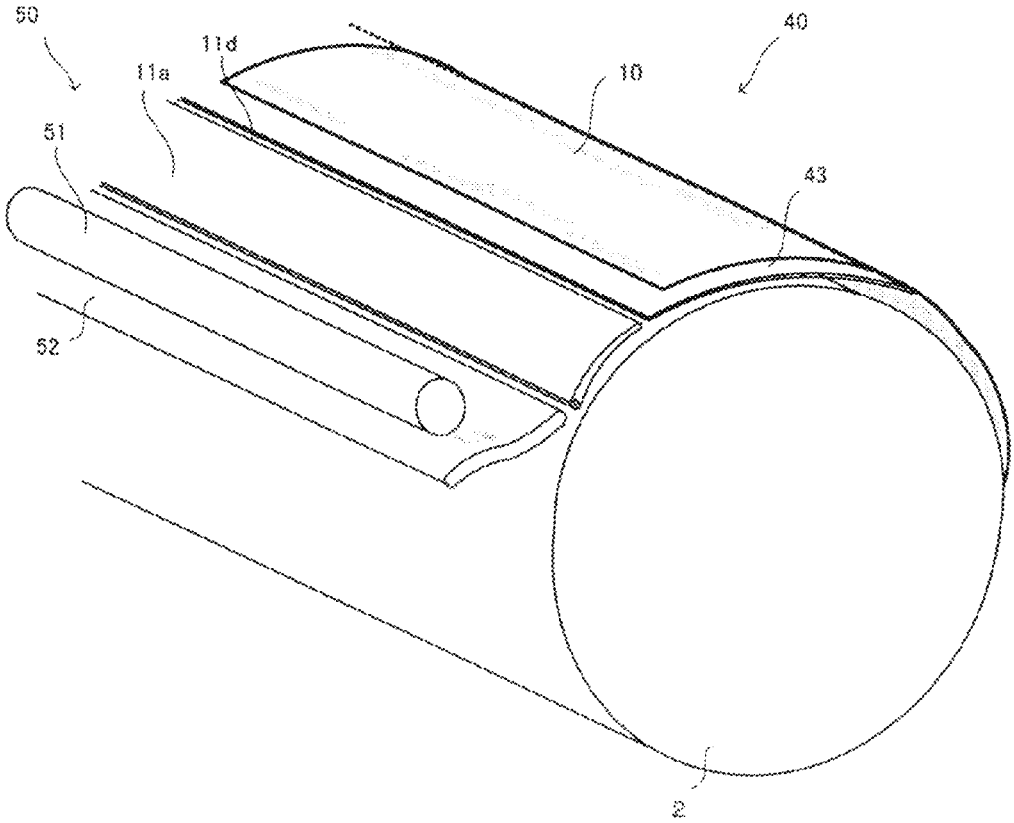
FIG. 5 is a perspective view showing the switching guide unit by means of the flapper plate of the present invention.
Figure 7:
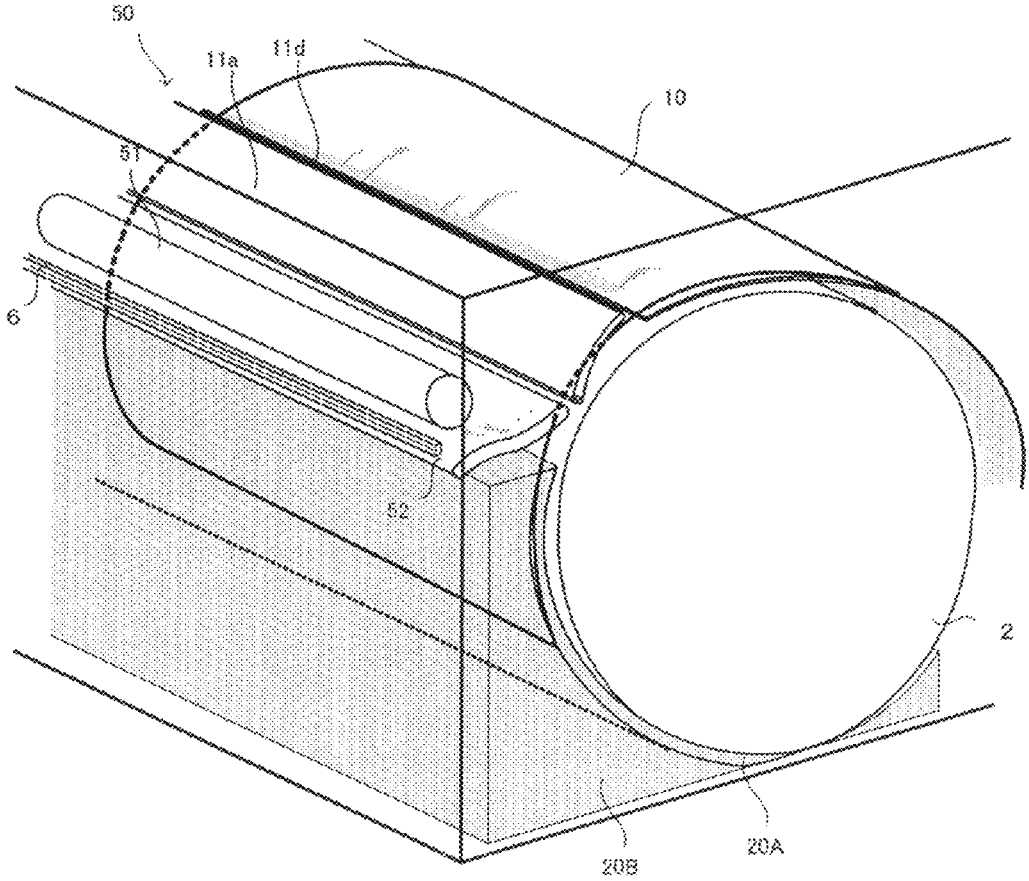
FIG. 7 is a perspective view showing the state of a recording paper storage unit in the first embodiment of the present invention.
Figure 8:
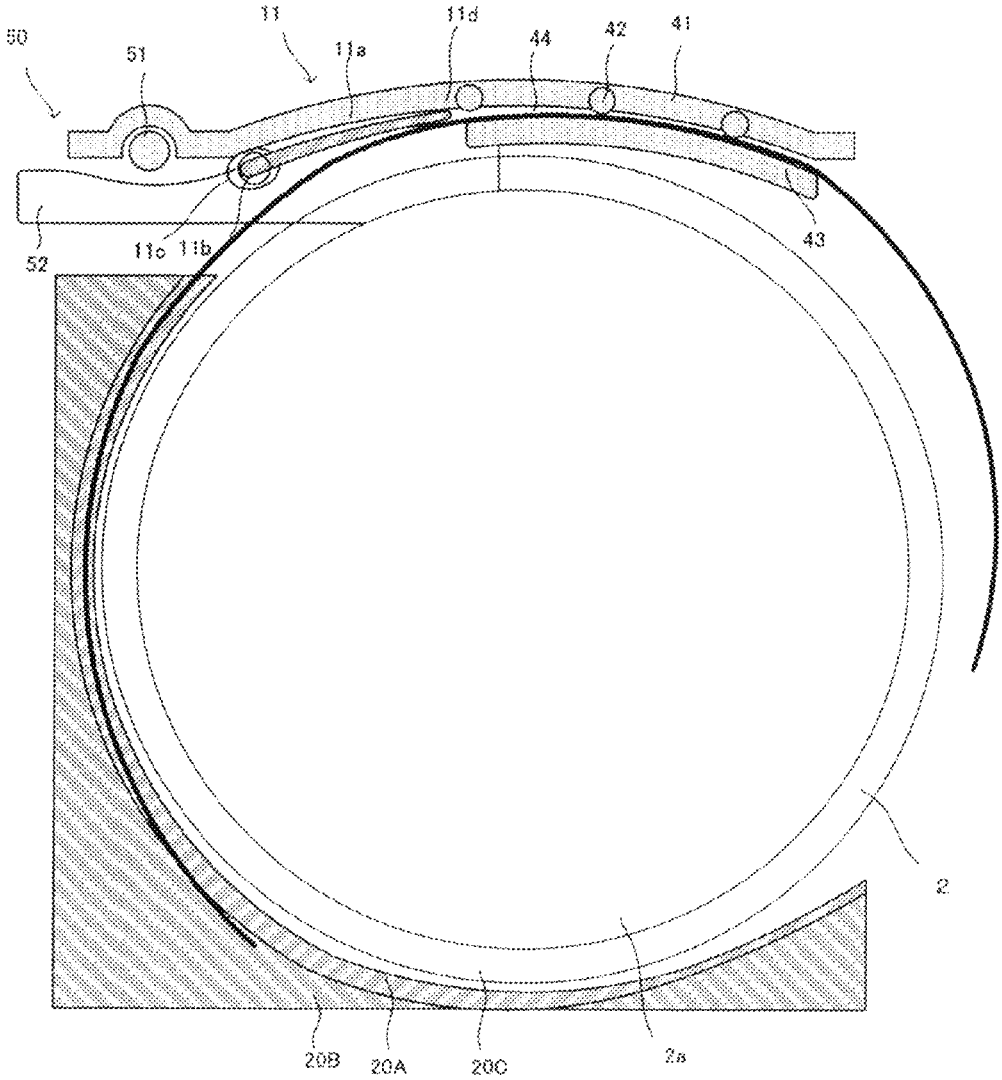
FIG. 8 is a cross section diagram showing the state in which a recording paper is temporarily set aside on the recording paper storage unit side in the first embodiment of the present invention.
Figure 9:
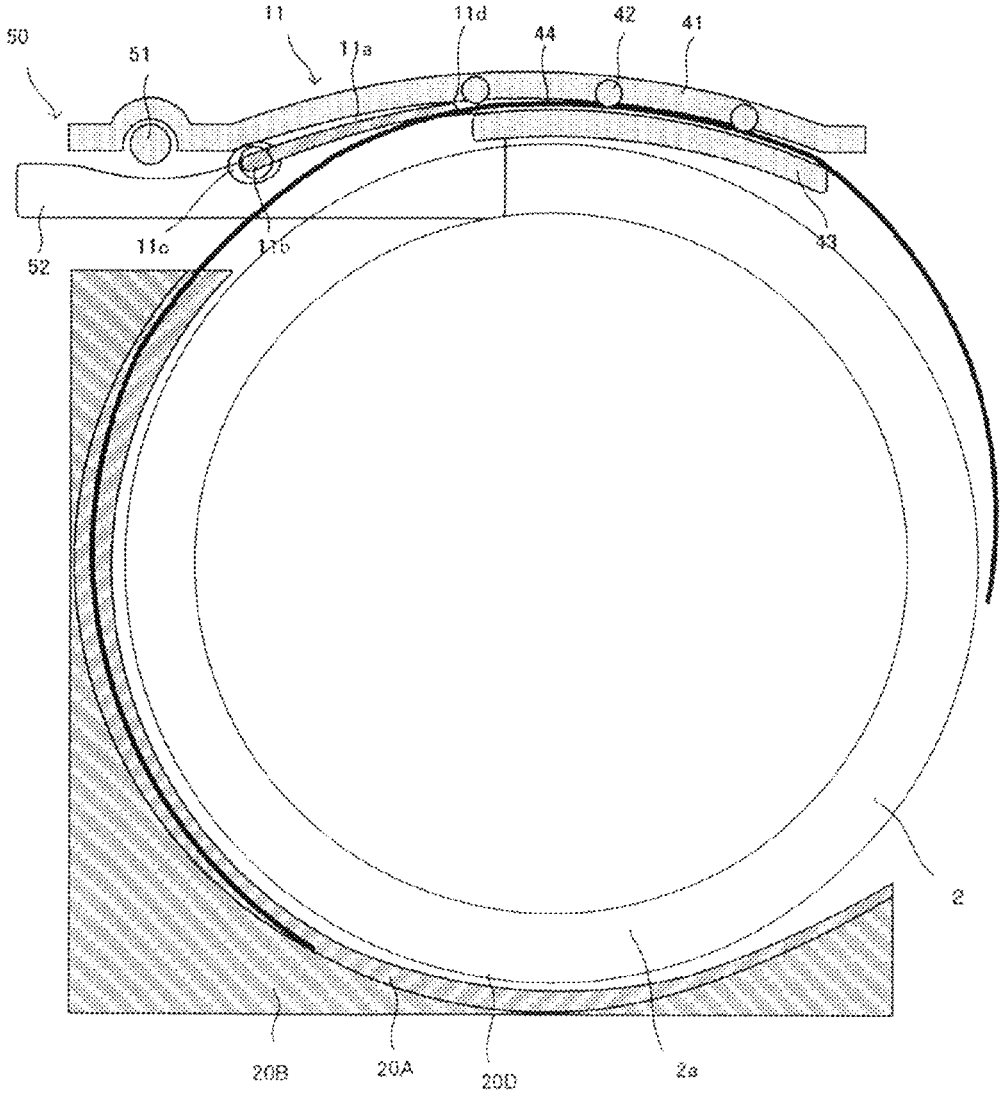
FIG. 9 is a cross section diagram showing the state in which a recording paper is temporarily set aside on the recording paper storage unit side in the first embodiment of the present invention.
Figure 10:
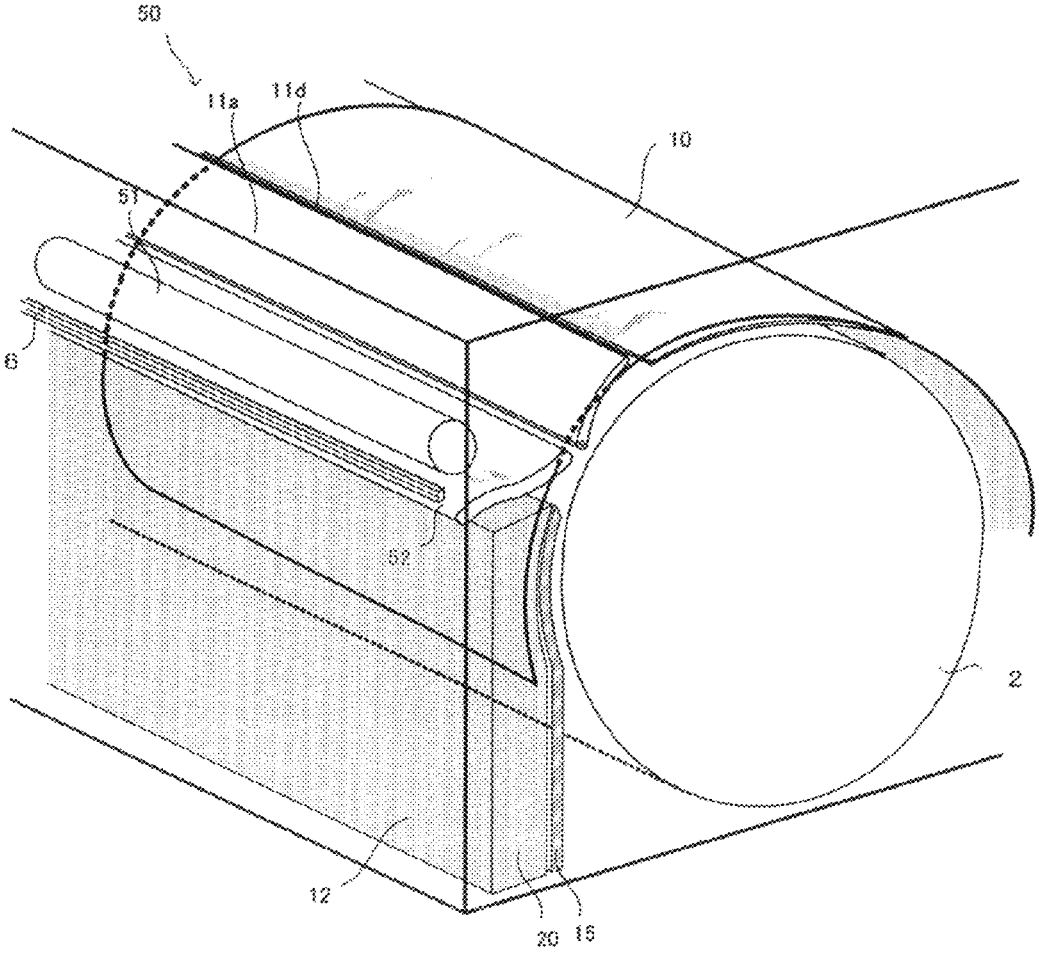
FIG. 10 is a perspective view showing the state of the recording paper storage unit in the second embodiment of the present invention.
Figure 11:
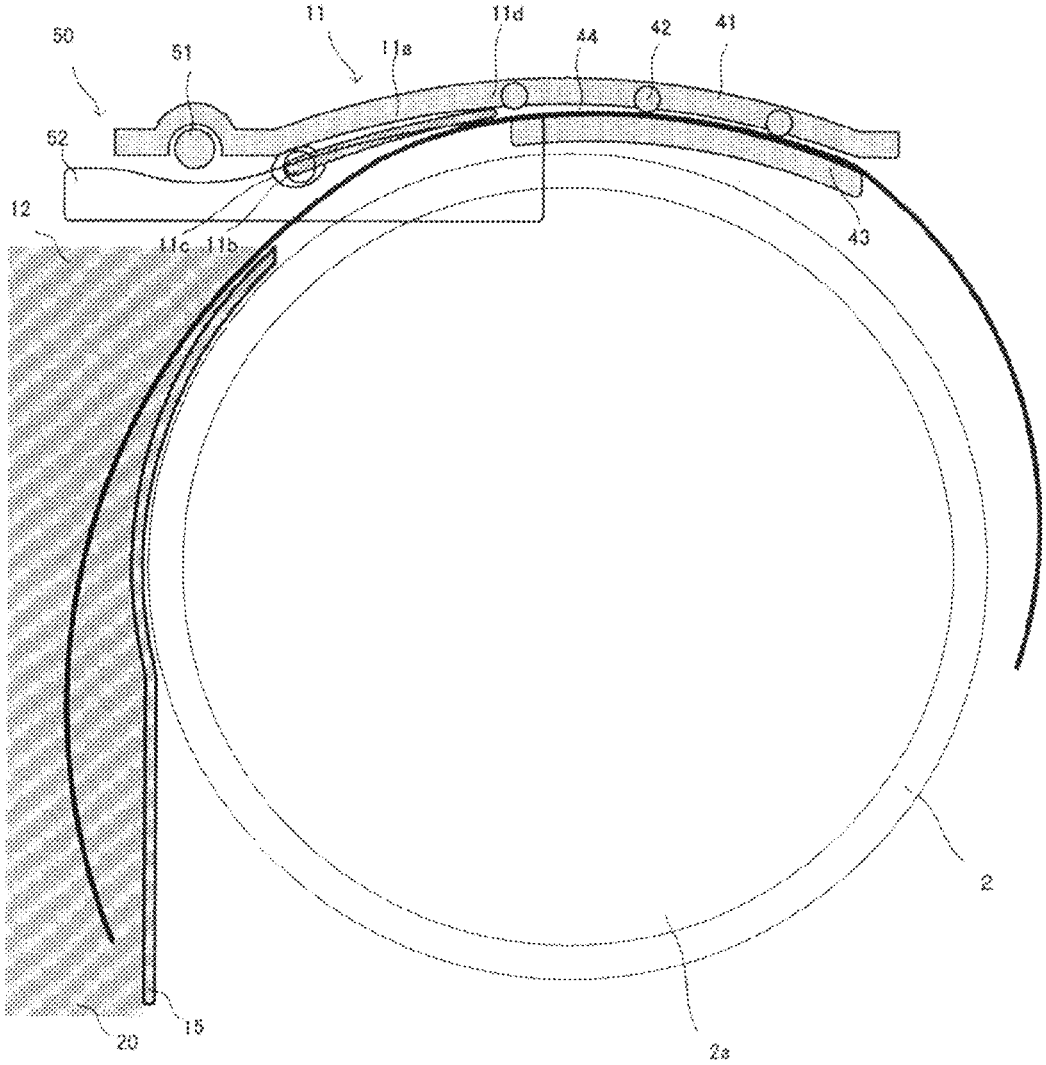
FIG. 11 is a cross section diagram showing the state in which a recording paper is temporarily set aside on the recording paper storage unit side in the second embodiment of the present invention.
Figure 12:
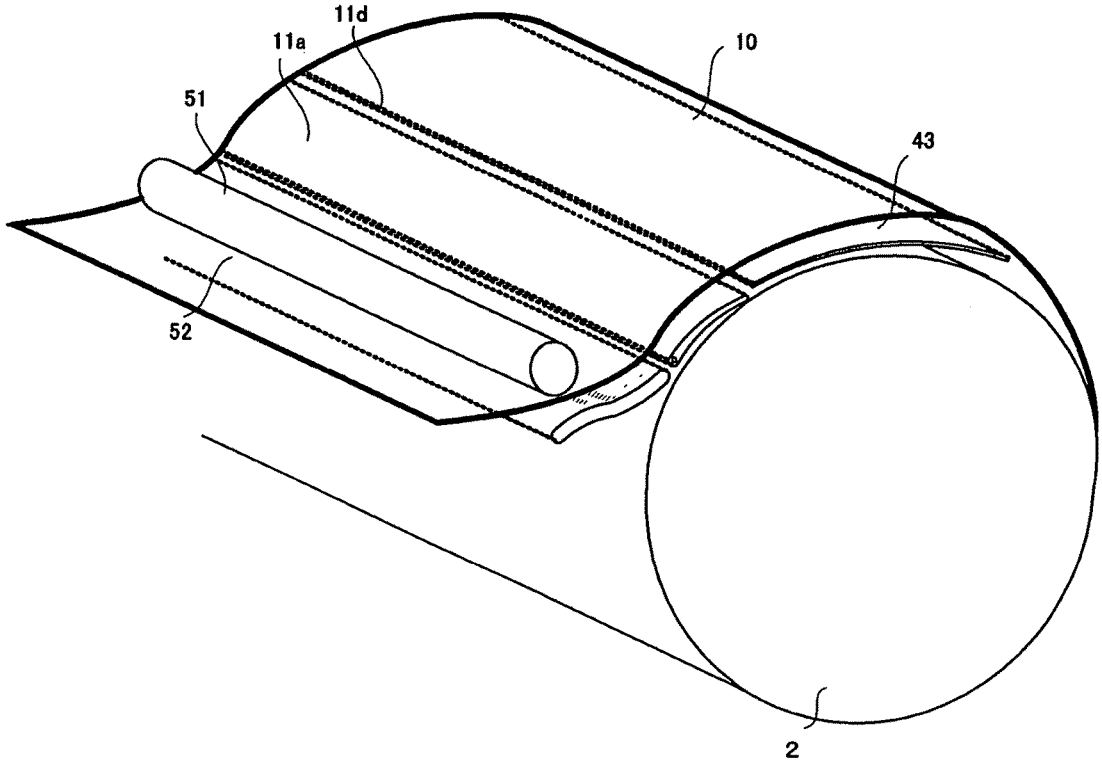
FIG. 12 is a perspective view showing the switching guide unit by means of the flapper plate of the present invention.
Figure 13:
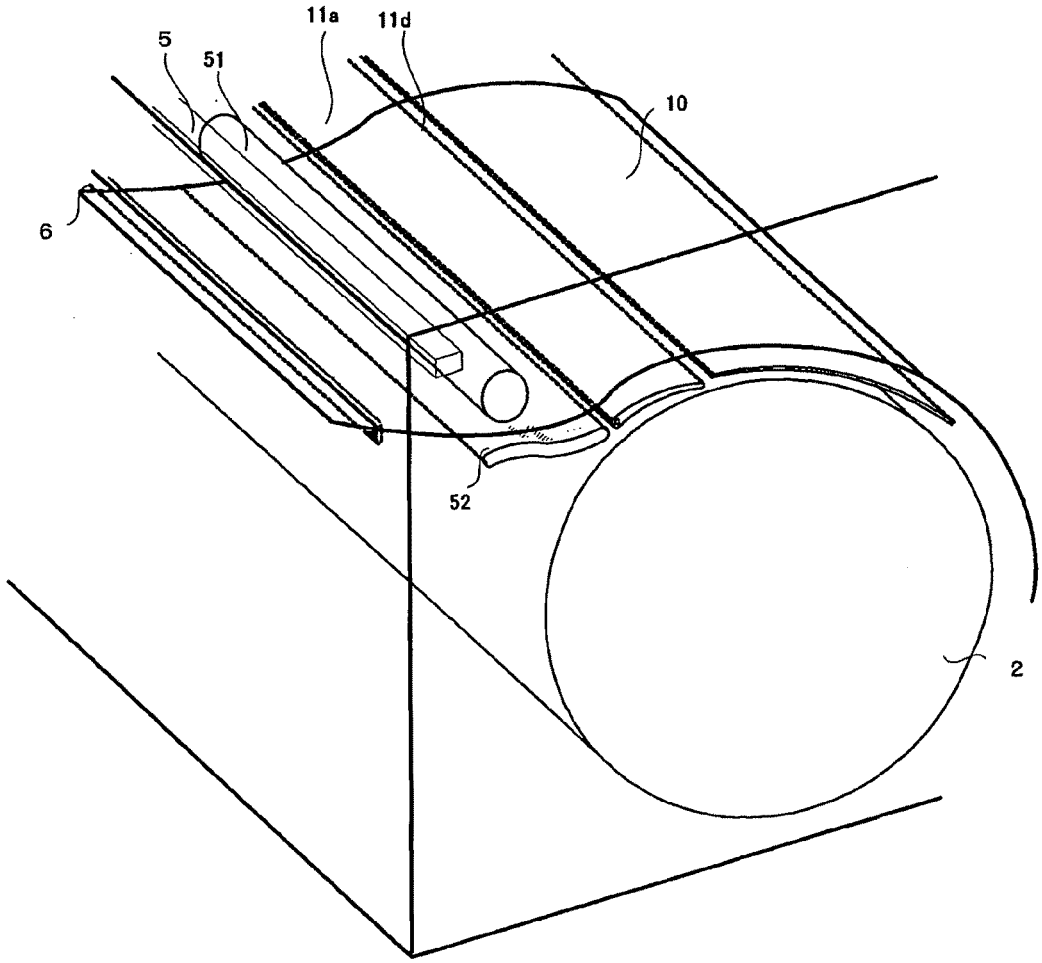
FIG. 13 is a perspective view showing the ejection state in which a recording paper is ejected in the present invention.

Next, the following describes the switching guide unit 11 and the recording paper storage unit 12 of the printer of the present invention with reference to FIG. 3 to FIG. 17. FIG. 3 to FIG. 5 each show an example of the configuration of the switching guide unit configured by a flapper plate and the operation of the switching guide unit, FIG. 6 to FIG. 11 show the operation in which a recording paper is temporarily set aside in the recording paper storage unit, FIG. 12 and FIG. 13 show the operation in which a recording paper is ejected externally of the printer, and FIG. 14 to FIG. 17 each show an example of the operation of the printer of the present invention. FIG. 7 to FIG. 9 show how a recording paper is temporarily set aside in the first embodiment, and FIG. 10 and FIG. 11 show how a recording paper is temporarily set aside in the second embodiment.

First, the following describes an example of the configuration of the switching guide unit, configured by a flapper gate, with reference to the cross section diagrams in FIG. 3 and FIG. 4. The switching guide unit 11 shown in FIG. 3 and FIG. 4 is an example of the configuration in which a flapper plate 11*a* is used. This flapper plate 11*a*, pivotally supported by an axis 11*b*, is held at one of two positions selected by a clutch mechanism 11*c* driven by a driving motor (not shown).

This flapper plate 11*a* is included in a guide mechanism 40 that is provided in the downstream side of the head 3 for guiding the recording paper 10 fed from the rolled paper holder 2. To allow the recording paper 10 to pass through and to be guided, this guide mechanism 40 has two guide plates 41 and 43, opposed with a gap between them, and multiple guide rollers 42 for guiding the recording paper 10. The guide rollers 42, though provided only on the top guide plate 41 in the configuration in FIG. 3, may be provided also on the bottom guide plate 43.

The guiding gap, formed by the guide plates 41 and 43, forms a guide groove 44. Forming the cross sectional shapes of the opposing faces of the guide plates into approximately circular shapes so that they fit the shape of a rolled recording paper allows the recording paper to be smoothly guided through the guide groove 44.

A curl correcting mechanism 50 can be provided in the downstream side of the guide mechanism 40 to bend the curved recording paper 10 the other way for correcting the curl. This curl correcting mechanism 50 comprises a correction roller 51 which is provided, for example, at the leading edge side of the guide plate 41 and a part of which sticks out from the bottom of the guide plate 41 into the guide groove 44; and a curl adjustment plate 52 which forms an extension of the guide groove 44 and is provided at a position opposite to the correction roller 51 to flatten the curl of the curved recording paper 10. As shown in FIG. 3, the correction roller 51 and the curved portion of the curl adjustment plate 52 are opposed to form the guide groove 44 that curves downward.

The recording paper 10 fed from the rolled paper holder 2 is curved toward the center of the rolled paper because it has been rolled. Because of this curve, the leading part of the recording paper 10 moves along the guide groove 44 formed between the guide plate 41 and the guide plate 43. At the trailing part of the guide mechanism 40, the recording paper 10 that has moved along the guide groove 44 has its curve bent the other way by the correction roller 51 and the curl adjustment plate 52, and the flattened recording paper is ejected externally of the printer from the ejection slot 6.

The flapper plate 11*a* is installed openably and closeably on the curl adjustment plate 52 by the axis 11*b*. The flapper plate 11*a* is installed with the opening/closing leading edge 11*d* on the head side. The state of the flapper plate 11*a* in which the leading edge of the recording paper 10 is sent to the recording paper storage unit 12 side is called the first state (state indicated by A in FIG. 3), and the state of the flapper plate 11*a* in which the leading edge of the recording paper 10 is sent to the ejection path 13 side is called the second state (state indicated by B in FIG. 3).

When the flapper plate 11*a* is in the first state, the leading edge 11*d* of the flapper plate 11*a* rises toward the bottom face of the guide plate 41 to block the recording paper path formed by the guide groove 44. This state causes the leading part of the recording paper 10, which has passed under the head and is guided via the guide groove 44, to abut on the bottom face of the flapper plate 11*a* and to have its traveling direction changed toward the recording paper storage unit 12 side.

On the other hand, when the flapper plate 11*a* is in the second state as shown in FIG. 4, the leading edge 11*d* of the flapper plate 11*a* falls and the top face of the flapper plate 11*a* becomes almost flush with the top face of the guide plate 43. Keeping the flapper plate 11*a* in this state causes the guide groove 44 to be extended to above the top face of the flapper plate 11*a*. This state causes the leading part of the recording paper 10, which has passed under the head and is guided via the guide groove 44, to travel on the top face of the flapper plate 11*a* and, via the curl correcting mechanism 50, to have its traveling direction changed toward the ejection path 13 side. The switching between the first state and the second state of the flapper plate 11*a* is driven by a motor via the clutch mechanism 11*c*.

Figure 6:
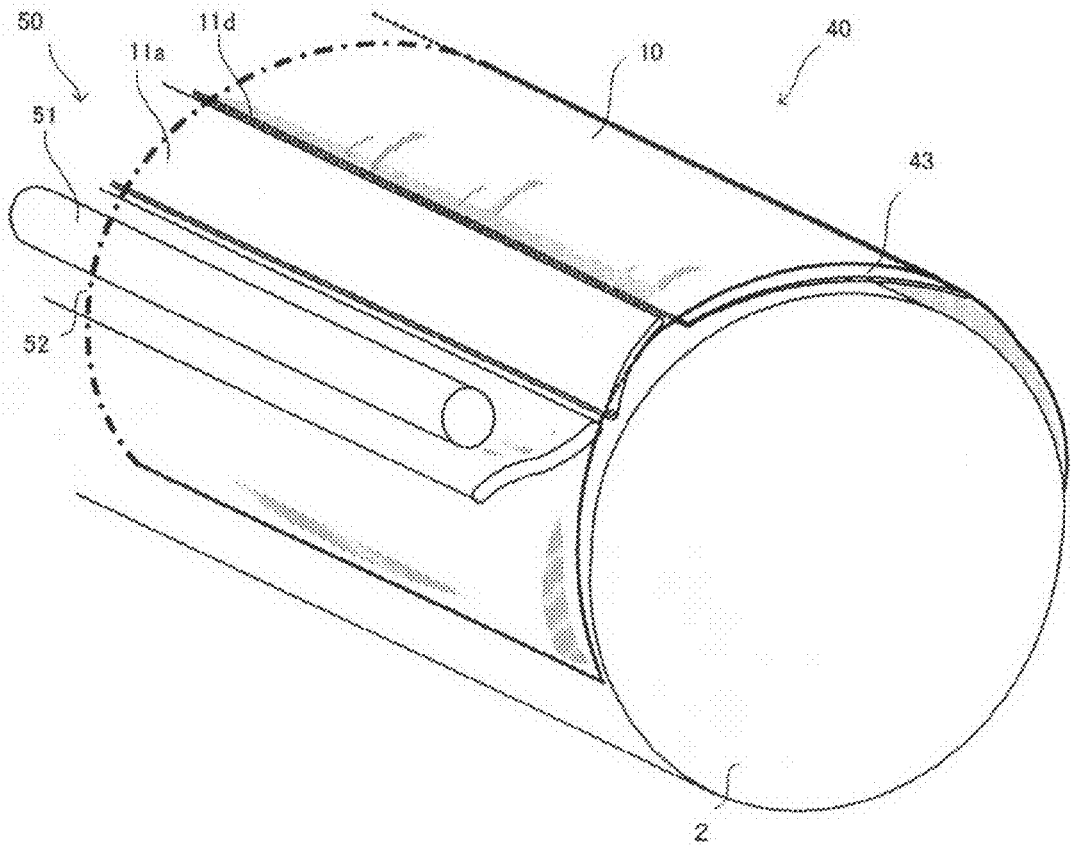
FIG. 6 is a perspective view showing the switching guide unit by means of the flapper plate of the present invention.

FIG. 5 and FIG. 6 are perspective views illustrating the switching guide unit by means of the flapper plate, and show a part of the guide unit 40 and the curl correcting mechanism 50. FIG. 5 shows the state in which the recording paper 10 is in front of the flapper plate 11*a*, and FIG. 6 shows the state in which the recording paper is directed toward the recording paper storage unit side with the flapper plate 11*a* in the first state. Note that the guide plate 41 is omitted in FIGS. 5 and 6. Also note that FIGS. 5 and 6, which schematically illustrate the diameter of the rolled paper holder 2 and the positional relation between the guide unit 40 and the curl correcting mechanism 50, do not necessarily show the actual device.

FIG. 6 shows the state in which the leading edge 11*d* of the flapper plate 11*a* is raised. The recording paper 10 passes below the bottom face of the flapper plate 11*a* and, after that, moves along the periphery of the rolled paper holder 2.

The following describes the first embodiment with reference to FIG. 7 to FIG. 9.

FIG. 7 is a perspective view showing the state of the recording paper storage unit in the first embodiment. Referring to FIG. 7, the storage space 20 of the recording paper storage unit 12 is delimited approximately by the periphery of the rolled paper holder 2. This figure shows two types of storage space 20 of the recording paper storage unit 12: one is a storage space 20A formed along the periphery of the rolled paper holder 2 and the other is an extended storage space 20B created by extending the border to the inner wall of the housing of the printer 1 or to a component installed in the printer 1.

The storage space 20A has the shape of a part of the cylindrical part formed along a part of the periphery of the rolled paper holder 2. The one end of the cylindrical part is below the flapper plate 11*a* of the switching guide unit 11, and the other end of the cylindrical part is in the position corresponding to the bottom of the rolled paper holder 2 or in the position that is beyond the bottom of the rolled paper holder 2 and that interferes with a component of the printer 1 such as the ink ribbon cassette.

The recording paper 10 fed from the rolled paper holder 2 has been rolled and so, when unrolled from the roll, it is still rolled. When the recording paper 10 is directed to the recording paper storage unit 12 side through the direction switching by the flapper plate 11*a*, it is stored in the storage space 20A that has the cylindrical shape similar to that of the rolled recording paper.

Although the storage space 20 can be extended to a storage space 20B shown in FIG. 7, it is rare that the recording paper, which is rolled, gets out of the storage space 20A described above and is stored in the storage space 20B.

So, in this case, the recording paper storage unit 12 in which the recording paper 10 is temporarily set aside is at least the storage space 20A that is delimited by the periphery of the rolled paper holder 2.

The cross section diagrams in FIG. 8 and FIG. 9 show the state in which a recording paper is temporarily set aside in the recording paper storage unit side in the first embodiment. In this state, with the leading edge 11*d* of the flapper plate 11*a* in the upper position, the path in the guide groove 44 is blocked in a halfway position. Blocking the path in this way switches the traveling direction of the leading edge of the recording paper 10 toward the recording paper storage unit 12.

The cross section diagram in FIG. 8 shows the state in which the remaining amount of the rolled paper on the rolled paper holder 2 is high, and the cross section diagram in FIG. 9 shows the state in which the remaining amount of the rolled paper on the rolled paper holder 2 is low. In any state, the recording paper can be stored and set aside in the peripheral part of the rolled paper holder 2 regardless of the remaining amount of the rolled paper.

The peripheral part of the rolled paper holder 2, which delimits the storage space 20 of the recording paper storage unit 12, can be delimited by the peripheral part of the rolled paper holder 2 itself or by the peripheral face of a rolled paper 2*a* held on the rolled paper holder 2.

FIG. 8 shows the state in which the remaining amount of the rolled paper 2*a* is high and so the diameter of the rolled paper 2*a* is large. In contrast, FIG. 9 shows the state in which the remaining amount of the rolled paper 2*a* is low and so the diameter of the rolled paper 2*a* is small. As a result, when the peripheral part of the rolled paper holder 2 includes the peripheral part of the rolled paper 2*a*, the storage space 20 of the recording paper storage unit 12 changes according to a change in the diameter of the rolled paper. In the states shown in FIG. 8 and FIG. 9, storage spaces 20C and 20D, each of which includes the peripheral part of the rolled paper 2*a*, are larger than the storage space 20A, which is delimited by the periphery of the rolled paper holder 2, by the amount of the recording paper that has been fed. The storage space 20D, which is a storage space when the remaining amount of the recording paper is low, is larger than the storage space 20C, which is a storage space when the remaining amount of the recording paper is high, by the difference in the remaining amount.

However, because the recording paper temporarily set aside in the recording paper storage unit 12 is the recording paper fed from the rolled paper holder, it is only required that the storage space 20 of the recording paper storage unit 12 be as large as the storage space 20A delimited by the periphery of the rolled paper holder 2.

Next, the following describes the second embodiment with reference to FIG. 10 and FIG. 11.

FIG. 10 is a perspective view showing the state of the recording paper storage unit in the second embodiment. The configuration in FIG. 10 shows an example in which the storage space 20 of the recording paper storage unit 12 is delimited by the dividing plate 15 and the front wall 16 of the printer housing. In the example of the configuration in FIG. 10, the chip storage unit is not shown.

The shape of the dividing plate 15 shown in FIG. 10 is only exemplary, and the present invention is not limited to this shape. For example, the shape of the dividing plate 15 may be a curved shape that fits the shape of the periphery of the rolled paper holder 2.

The recording paper 10 fed from the rolled paper holder 2 has been rolled and so, when unrolled from the roll, it is still rolled. So, when directed toward the recording paper storage unit 12 side through the direction switching by the flapper plate 11*a*, the recording paper 10 is stored in the storage space 20 of the recording paper storage unit 12.

FIG. 11 is a cross section diagram showing the state in which the recording paper is temporarily set aside in the recording paper storage unit side in the second embodiment. In this state, with the leading edge 11*d* of the flapper plate 11*a* in the upper position, the path in the guide groove 44 is blocked in a halfway position. Blocking the path in this way switches the traveling direction of the leading edge of the recording paper 10 toward the recording paper storage unit 12.

The recording paper storage unit 12 can store the recording paper 10 in the storage space 20 for setting it aside regardless of the remaining amount of the rolled paper held on the rolled paper holder 2.

When the remaining amount of the rolled paper 11*a* is high, the diameter of the rolled paper 11*a* becomes large. In contrast, when the remaining amount of the rolled paper 11*a* is low, the diameter of the rolled paper 11*a* becomes small. The degree of the curve in the recording paper unrolled from the rolled paper 11*a* and stored in the storage space 20 varies according to the remaining amount of the rolled paper 11*a*. However, because the storage space 20 of the recording paper storage unit 12 is delimited by the dividing plate 15 and the front wall 16 or the wall of the chip storage unit (not shown), the recording paper 10 can be stored regardless of the diameter of the rolled paper 11*a* or the degree of the curve in the stored recording paper 10.

Once the size of the area to be printed (for example, L size, 2L size, etc.) is determined, the length of the recording paper 10 introduced into the recording paper storage unit 12 is approximately fixed. This means that the capacity of the storage space 20 of the recording paper storage unit 12 can be determined according to the maximum length of the recording paper 10 to be introduced into the recording paper storage unit 12.

If the capacity of the storage space 20 of the recording paper storage unit 12 is not sufficient enough, the recording paper can be brought out of the printer by the switching guide unit 11.

The following describes how a recording paper is ejected from the printer in the first and second embodiments with reference to FIG. 12 and FIG. 13.

FIG. 12 shows the state in which the leading edge 11*d* of the flapper plate 11*a* is lowered. In this state, the recording paper 10 passes on the top face of the flapper plate 11*a*, passes through the curl correcting mechanism 50, passes through the ejection path 13, and is ejected externally from the ejection slot.

FIG. 13 is a perspective view showing the ejection state of a recording paper. Referring to FIG. 13, the recording paper 10, whose traveling direction has been switched by the flapper plate 11*a*, passes through the curl correcting mechanism 50, passes through the ejection path 13, and is ejected externally from the ejection slot 6. At this time, the recording paper 10 is cut to a predetermined length by the recording paper cutting unit 5 before being ejected. It is also possible to cut the recording paper 10 into small chips for storing the chips in the printer 1 to prevent them from being ejected externally. Note that the recording paper storage unit 12 is not shown in FIG. 12 and FIG. 13.

Figure 14:
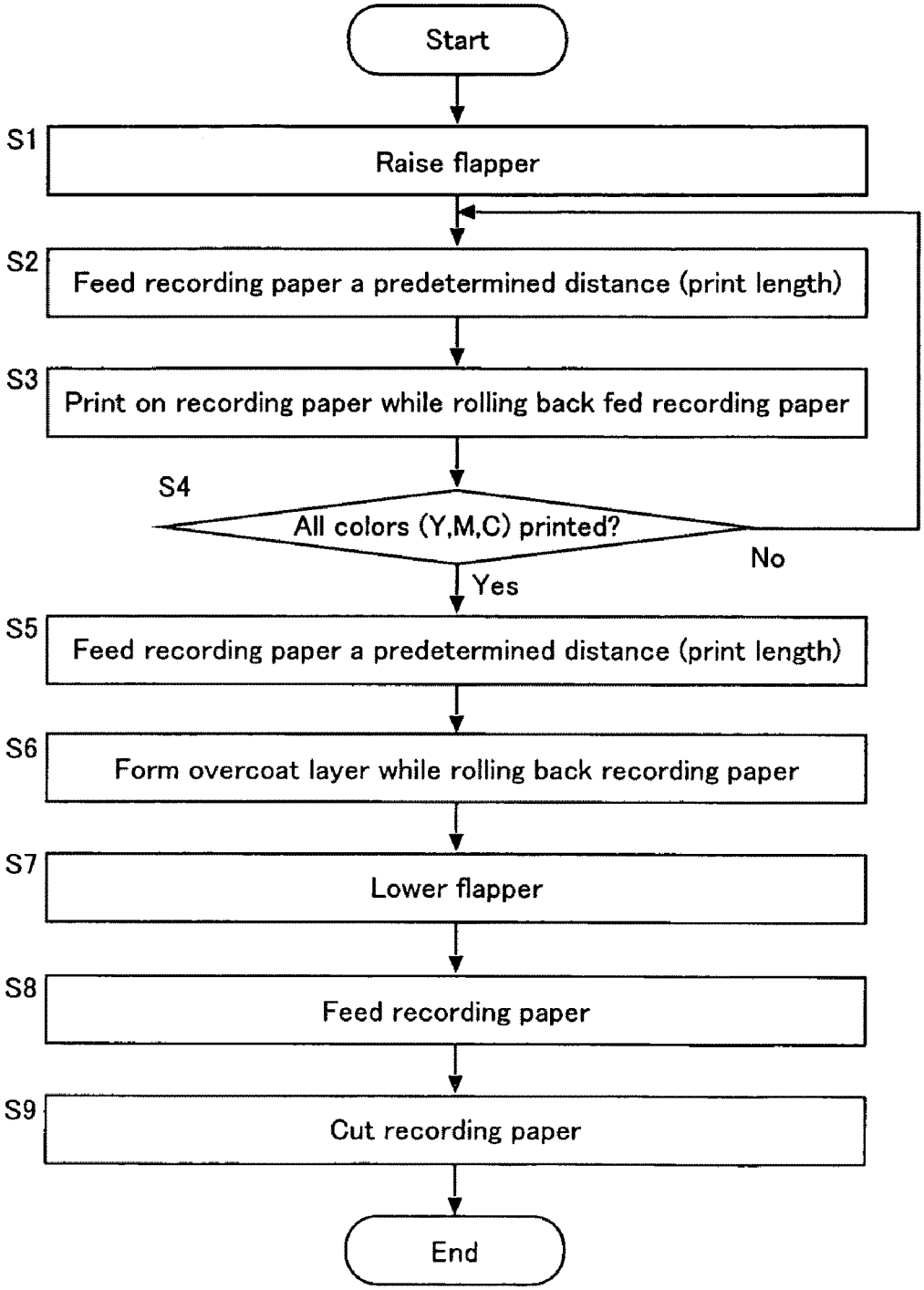
FIG. 14 is a flowchart showing an example of the operation of the printer of the present invention.

Next, the following describes an example of the operation of the printer according to the present invention with reference to the flowchart in FIG. 14 and the operation diagram in FIG. 15. The following mainly describes the operation of the switching guide unit.

Figure 15A:
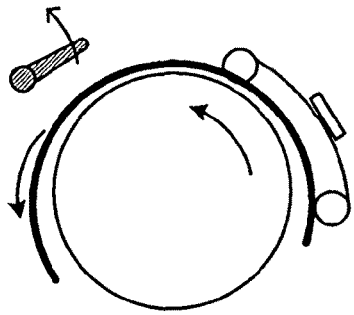
FIG. 15 is an operation diagram showing an example of the operation of the printer of the present invention.

First, the flapper panel is raised (S1), and the recording paper is fed a predetermined distance (FIG. 15A). The length of the fed recording paper can be set based on the size of the print area to be printed on the recording paper. The size of the print area to be printed on the recording paper, which depends on the length of the ink part that is set for the ink ribbon as described above, can be determined by acquiring the data on the type of the ink ribbon that is set on the printer. For example, when an ink ribbon for L-size printing is set, the information indicating that the print size is the L size is acquired from this ink ribbon and the paper is fed for the length corresponding to the L size. When the ink ribbon that is set on the printer is an ink ribbon for 2L-size printing, the paper is fed for the length corresponding to the 2L size. The fed recording paper has its traveling direction switched by the switching guidance unit into the recording paper storage unit side and is temporarily set aside in the recording paper storage unit (S2).

Figure 15B:
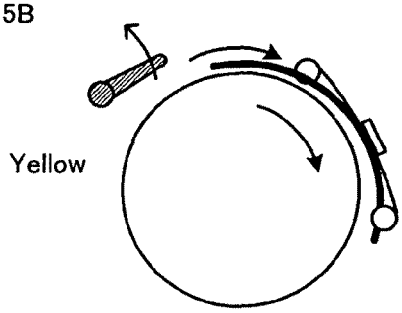
Figure 15C:
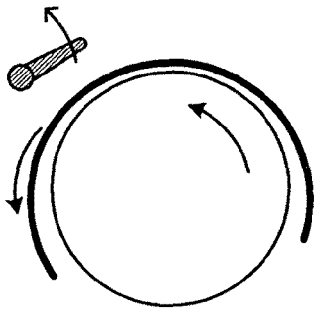
Figure 15D:
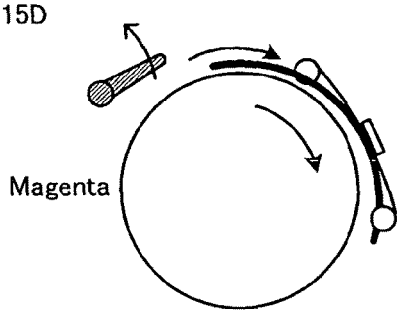
Figure 15E:
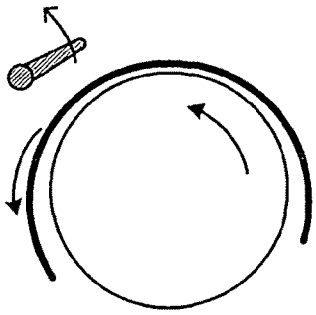
Figure 15F:
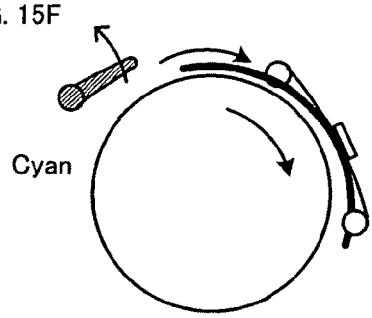
Figure 15G:
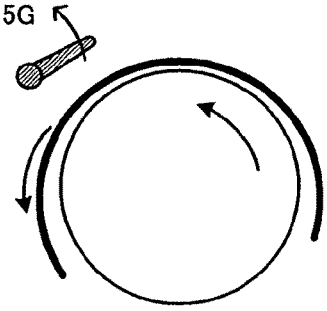
Figure 15H:
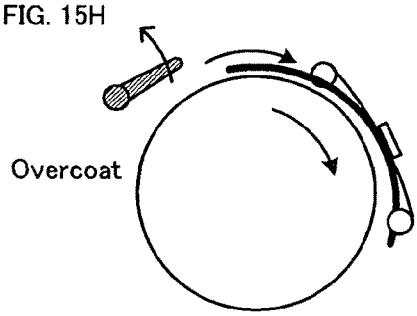
Figure 15I:
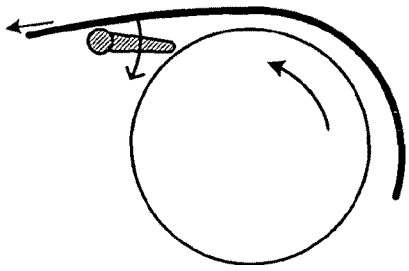

The printer prints on the recording paper using the head while rolling the fed recording paper (FIG. 15B). At this time, the ink ribbon attached to the ink ribbon cassette is also moved. The rolling of the recording paper, the winding of the ink ribbon, and the image print processing by the head are all in synchronization (S3).

The printer performs color printing by repeating steps S2 and S3 described above for each of yellow(Y), magenta(M), and cyan(C) in the same recording area on the recording paper (FIG. 15C to FIG. 15F) (S4).

A protective layer can be formed by coating the print face, on which an image has been printed, with an overcoat layer. To form the overcoat layer of this film, the recording paper is fed a predetermined distance in the same manner as in S2 described above (FIG. 15G) (S5) and, after that, the overcoat layer is formed while rolling the recording paper in the same manner as in S3 described above (FIG. 15H). This overcoat layer can be provided by the same steps as those for the color formation by forming the overcoat layer on the ink ribbon with the yellow(Y), magenta(M), and cyan(C) color parts (S6).

The flapper plate is lowered after the colors are printed, and the overcoat layer is formed, on the recording paper. After step S6 is terminated, the recording paper is rolled on the rolled paper holder. When the recording paper is fed from the rolled paper holder with the flapper plate lowered, the printed recording paper is sent out from the ejection slot because the flapper plate has been switched to cause the recording paper to be sent to the ejection path side (FIG. 15I) (S8). At this time, after sent out a predetermined distance, the recording paper is cut. This cutting causes the printed recording paper of a predetermined length to be ejected from the printer (S9).

The operation is described above in which the recording paper is temporarily set aside in the recording paper storage unit when multiple colors are printed by the printer of the present invention. When the recording paper is longer than can be stored in the recording paper storage unit, the temporary set-aside operation is difficult and so multiple colors cannot be printed by the above operation.

The printer of the present invention can solve this problem by causing the switching guide unit to send the recording paper, not to the recording paper storage unit side, but to the ejection path side during the temporary set-aside operation. In this operation mode, the recording paper is temporarily stuck out externally from the ejection slot of the printer during the temporary set-aside time.

Figure 16:
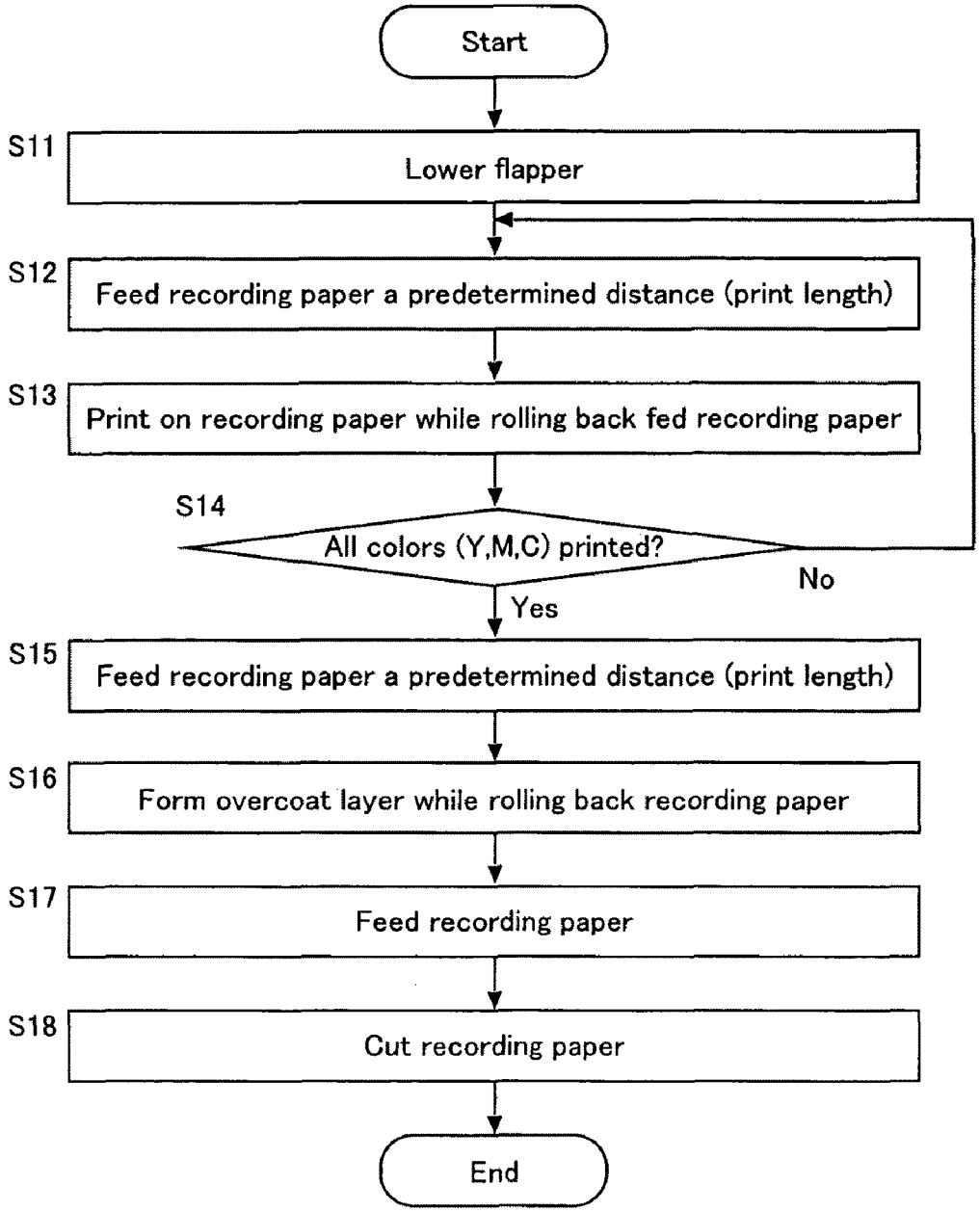
FIG. 16 is a flowchart showing another example of the operation of the printer of the present invention.

The following describes an example of the operation that is performed when the print area is too long to be temporarily set aside in the recording paper storage unit of the printer of the present invention, with reference to the flowchart in FIG. 16 and the operation diagram in FIG. 17. The following mainly describes the operation of the switching guide unit.

Figure 17A:
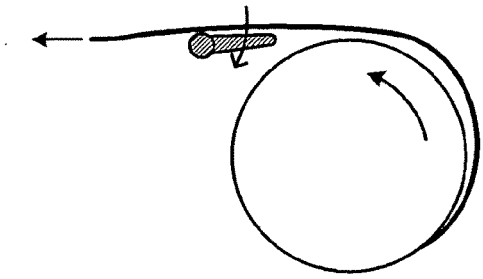
FIG. 17 is an operation diagram showing another example of the operation of the printer of the present invention.

First, the flapper plate is lowered (S11) and the recording paper is fed a predetermined distance (FIG. 17A). The distance for which the recording paper is fed can be set based on the length of the print area to be printed on the recording paper. In this example, assume that the recording paper is fed a distance corresponding to a long print area such as the A5 size. The length of this print area can be determined as described above by acquiring the data on the type of the ink ribbon that is set on the printer. The traveling direction of the fed recording paper has been switched to the ejection path side by the switching guide unit and, so, the recording paper is stuck out externally from the ejection slot of the printer during the temporary set-aside operation (S12).

Figure 17B:
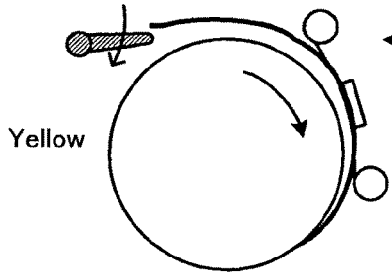
Figure 17C:
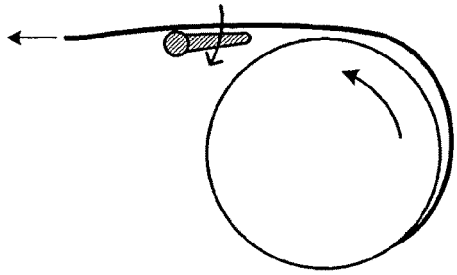
Figure 17D:
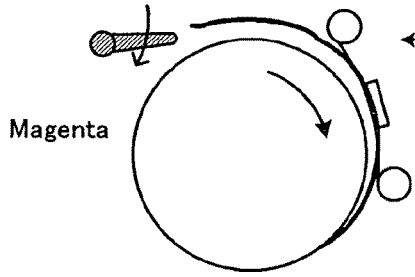
Figure 17E:
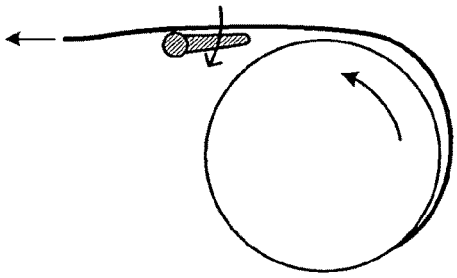
Figure 17F:
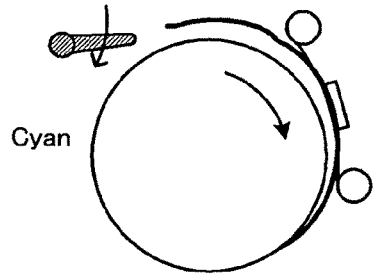
Figure 17G:
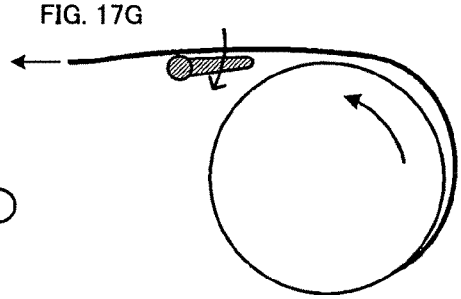
Figure 17H:
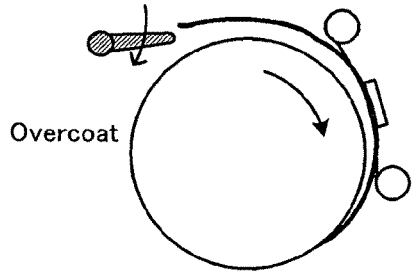
Figure 17I:
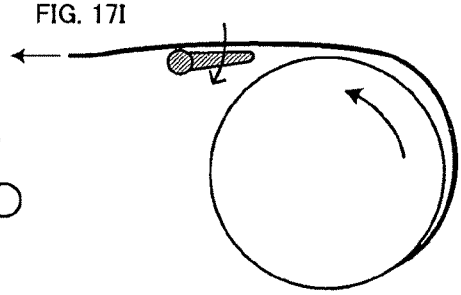

The printer prints on the recording paper using the head while rolling the fed recording paper (FIG. 17B). At this time, the ink ribbon attached to the ink ribbon cassette is also moved. The rolling of the recording paper, the winding of the ink ribbon, and the image print processing by the head are all in synchronization (S13).

The printer performs color printing by repeating steps S12 and S13 described above for each of yellow(Y), magenta(M), and cyan(C) in the same recording area on the recording paper (FIG. 17C to FIG. 17F) (S14).

A protective layer can be formed by coating the print face, on which an image has been printed, with an overcoat layer. To form the overcoat layer of this film, the recording paper is fed a predetermined distance in the same manner as in S12 described above (FIG. 17G) (S15) and, after that, the overcoat layer is formed while rolling the recording paper in the same manner as in S13 described above (FIG. 17H). This overcoat layer can be provided by the same steps as those for the color formation by forming the overcoat layer on the ink ribbon with the yellow(Y), magenta(M), and cyan(C) color parts (S16).

After step S16 is terminated, the recording paper is rolled on the rolled-paper holder, and the flapper plate is lowered. When the recording paper is fed from the rolled-paper holder in this state, the printed recording paper is sent out from the ejection slot (FIG. 17I) (S18). At this time, after sent out a predetermined distance, the recording paper is cut. This cutting causes the printed recording paper of a predetermined length to be ejected from the printer (S19).

The example of configuration described above is only exemplary. The present invention is not limited to this example but includes various modifications.

The invention claimed is:

1. A printer comprising:

a rolled paper holder that holds a rolled recording paper;

an ejection path through which the recording paper is ejected externally of the printer;

a recording paper storage unit in which the recording paper is temporarily stored; and a switching guide unit that guides a leading edge of the recording paper by switching between said ejection path and said recording paper storage unit, wherein said recording paper storage unit is formed at least by a part of a periphery of the rolled recording paper, and the recording paper is temporarily stored in a space in which an unrolled recording paper was occupied.

2. A printer comprising:

a rolled paper holder that holds a rolled recording paper;

a head that prints on the recording paper unrolled from a roll into a long sheet of paper;

a recording paper storage unit in which the recording paper that has passed under said head is stored temporarily;

an ejection slot through which the printed recording paper is ejected; and a switching guide unit that guides a leading edge of the recording paper to said ejection slot when the guide unit is in a first state and guides the leading edge of the recording paper to said recording paper storage unit when the guide unit is switched to a second state, wherein said head and said ejection slot are provided on opposite sides across said rolled paper holder in a conveyance direction of the recording paper, and said recording paper storage unit is provided between an ejection slot side part of said rolled paper holder and said ejection slot.

3. A printer comprising:

a rolled paper holder that holds a rolled recording paper;

an ejection path through which the recording paper is ejected externally of the printer;

a recording paper storage unit in which the recording paper is temporarily stored; and a switching guide unit that guides a leading edge of the recording paper by switching between said ejection path and said recording paper storage unit, wherein said recording paper storage unit is provided in a space between said rolled paper holder and a front wall on a side on which the recording paper is ejected, and the recording paper is temporarily stored in a space in which an unrolled recording paper was occupied.

4. The printer according to claim 3, further comprising:

a dividing plate adjacent to at least a part of a periphery of said rolled paper holder wherein said dividing plate is one of a plurality of wall surfaces of said recording paper storage unit.

5. The printer according to claim 4 wherein said front wall is another of the plurality of wall surfaces of said recording paper storage unit.

6. The printer according to claim 4, further comprising:

a second dividing plate adjacent to said front wall, wherein said second dividing plate is another of the plurality of wall surfaces of said recording paper storage unit.

7. The printer according to claim 1 or 3 wherein when an image equal to or shorter than a storage length of said recording paper storage unit is printed, said switching guide unit guides the leading edge of the recording paper that is being printed to said recording paper storage unit, and guides the leading edge of the recording paper that has been printed to said ejection path.

8. The printer according to claim 1 or 3 wherein when an image longer than a storage length of said recording paper storage unit is printed, said switching guide unit guides the leading edge of the recording paper that is being printed or that has been printed to a side of said ejection path.

9. The printer according to claim 1 or 3 wherein said switching guide unit comprises a flapper plate pivotally supported in at least two switching positions including a first switching position, via which the leading edge of the recording paper is guided to a recording paper storage unit side, and a second switching position, via which the leading edge of the recording paper is guided to an ejection path side, and the recording paper is guided by the switching positions of said flapper plate.

10. The printer according to claim 9 wherein said switching guide unit sets the flapper plate to the first switching position at least when printing is started and switches the flapper plate from the first switching position to the second switching position when printing is terminated.

11. The printer according to claim 9 wherein when an image longer than a storage length of said recording paper storage unit is printed, said switching guide unit sets the flapper plate to the second switching position to guide the leading edge of the recording paper to the ejection path side during printing.

12. The printer according to claim 1 or 3, further comprising:

on said ejection path, a recording paper cutting unit that cuts the recording paper; and an ejection slot through which the recording paper is ejected externally of a housing of the printer and below said recording paper cutting unit, a chip storage unit in which chips of the recording paper cut by said recording paper cutting unit are stored.

13. The printer according to claim 12 wherein a wall surface of said chip storage unit is a wall of said recording paper storage unit.

14. The printer according to one of claims 1-3 wherein the rolled recording paper has a central axis that is supported to allow the rolled recording paper to be rotatably stored on the rolled paper holder.

* * * * *